US007131645B2

(12) United States Patent
Bodereau

(10) Patent No.: US 7,131,645 B2
(45) Date of Patent: Nov. 7, 2006

(54) DEVICE FOR SEPARATION OF FOLDERS IN A LAYER OF FOLDERS

(75) Inventor: Jean-Pierre Bodereau, Cherre (FR)

(73) Assignee: Recmi Industrie, Cherre (FR)

( * ) Notice: Subject to any disclaimer, the term of this patent is extended or adjusted under 35 U.S.C. 154(b) by 0 days.

(21) Appl. No.: 10/873,518

(22) Filed: Jun. 23, 2004

(65) Prior Publication Data

US 2005/0285332 A1 Dec. 29, 2005

(51) Int. Cl.
*B65H 5/34* (2006.01)

(52) U.S. Cl. ..... 271/270; 271/69; 271/182; 271/202

(58) Field of Classification Search ..... 271/69, 271/182, 183, 216, 270, 202; 53/542; 198/419.1, 198/418.9
See application file for complete search history.

(56) References Cited

U.S. PATENT DOCUMENTS 3,149,834 A * 9/1964 Faeber ..... 271/256
3,313,221 A * 4/1967 Ferdinand ..... 271/258.03
3,373,666 A * 3/1968 Crampton ..... 414/789
3,834,288 A * 9/1974 Behrens et al. ..... 198/418.9
3,842,719 A * 10/1974 Fernandez-Rana et al. ..... 198/418.9
3,874,522 A * 4/1975 Fernandez-Rana ..... 414/788.1
4,238,024 A * 12/1980 Hirakawa et al. ..... 198/418.9
4,297,066 A * 10/1981 Ramcke et al. ..... 414/790.2
4,546,871 A * 10/1985 Duke ..... 198/418.9
4,585,227 A * 4/1986 Muller ..... 271/270
4,641,489 A * 2/1987 Wood ..... 53/529
4,746,004 A * 5/1988 Hess et al. ..... 198/418.9
4,772,003 A * 9/1988 Nobuta et al. ..... 270/52.14
4,824,093 A * 4/1989 Belden ..... 271/216
4,869,487 A * 9/1989 Uno ..... 271/3.05
5,158,278 A * 10/1992 Auf der Mauer ..... 271/270
6,189,884 B1 * 2/2001 Jeske ..... 271/182
6,295,922 B1 * 10/2001 Salamone et al. ..... 100/7
6,945,531 B1 * 9/2005 Perobelli et al. ..... 271/270

* cited by examiner

*Primary Examiner*—Eileen D. Lillis
*Assistant Examiner*—Kaitlin Joerger
(74) *Attorney, Agent, or Firm*—Young & Thompson

(57) ABSTRACT

A device for separation of folders within a layer of folders includes elements for blocking the advance of a folder in the layer, elements for unlayering the folders preceding the retained folder, and elements for retaining the blocked folder and the folders following it relative to the advance of the layer acting successively on the folders.

18 Claims, 5 Drawing Sheets

DEVICE FOR SEPARATION OF FOLDERS IN A LAYER OF FOLDERS

BACKGROUND OF THE INVENTION

The present invention relates to a separating device to form a bundle of stacked folders, by offsetting the folders in a layer of advancing folders.

During stacking of the folders, there are formed bundles of stacked folders to package them for transport. To form these bundles, it is necessary to carry out a separation between two folders in the formed stack.

DESCRIPTION OF THE RELATED ART

To produce this separation between two folders, there have previously been proposed many and varied devices. Thus, there are known separators acting within the bundle undergoing formation, and others causing an interruption in the layer.

Thus, there is known a separator acting directly in the bundle without interruption of the layer, as described in the patent EP 0 739 843 of the applicant and in the patent EP 0 872 443. Such a separator is introduced into the stack of folders either from below the bundle, a hook introduced between two folders retaining one of the folders against the direction of advance creating a space for the introduction of the separator, or at the point of stacking, a tab being disposed between two folders and then spacing the folders to let the separator pass.

These separators acting within the stack of folders without interruption of the layer are not suitable for all the forms of folders, in particular deep and wide forms. Moreover, they have the tendency systematically to raise the folders for certain productions during the introduction of the separator into the bundle, even when the system uses devices for pre-introduction into the layer such as tabs.

For separators with interruption of the layer, there has been proposed a separator comprising a hook which acts within the layer of folders by retaining one folder relative to the adjacent folder as well as a separator with movement by a jack which also permits providing a separation.

However, such systems have drawbacks. In particular, these systems are not adapted for stacking devices in which the speed of the layer of folders and the flow of the folders are rapid.

Thus, the precision of interruption created within the layer by the separators is insufficient to be able to obtain a suitable synchronization with the movement of the bundle to be terminated, located upstream of the device. Moreover, there generally occurs too great an accumulation of folders among the folders which follow the interruption and the time of interruption that is needed is too long to be able to compensate the imprecision and to guarantee that the interruption is fairly long.

Moreover, the interruption caused by these separators is always greater than the interruption or the simple offset of a single folder relative to the following one so as then to introduce downstream into the bundle undergoing formation a separation member. This greater interruption permits guaranteeing the reliability of execution.

However, when the separator of this type operates, the folders which follow the interruption of the layer accumulate against the stop member of the layer, which gives rise to a phenomenon of inversion of the interval of the layer having as a result a disturbance of the stacking of the first folders on the downstream stacking device.

SUMMARY OF THE INVENTION

The present invention thus has for its object to overcome these drawbacks by providing a device for separating folders in the layer which permits an offset of one folder relative to another which will be equivalent to the precise height of the separation member located downstream.

To this end, the invention has for its object a device for the separation of folders within a layer of folders, characterized in that it comprises means for blocking one folder in the layer, means for unlayering folders preceding the blocked folder, and means for holding the blocked folder and the folders following it relative to the advance of the layer acting successively on said folders.

Thus preferably there is obtained a simple offset of the folders without disordering them, the holding means for the folders permitting opposing itself to their advance progressively, which permits controlling the accumulation of the folders. In this way, there is desirably reduced the interval of the layer, the blocked folders "recoiling" relative to the advance of the layer.

Thus, the layer of folders continues to advance and the progressive blocking of the folders after blocking permits reducing the interval of the layer in a controlled manner instead of letting the folders accumulate in a disordered manner behind the blocked folder.

Preferably, the blocking means and the unlayering means are positioned, relative to the direction of advance of the layer, downstream of the retention means. Preferably, the blocking means face the advance of the layer when they act. Thus, these blocking means, which have a pivotal axis permitting driving a blocking member between an inactive position above the layer and an active blocking position within the layer of folders, are positioned such that the pivotal axis is downstream of the point of blocking in the layer. In this way, there is desirably avoided the drawbacks connected with an upstream position of the pivotal axis relative to the blocking point. Thus, if there is carried out a stoppage in the layer with the pivotal axis located upstream, the separation is less reliable and can let a further folder escape, disturbing the precision of the separation.

This action of the blocking means, facing the layer, guarantees that no folder can jump over the blocking means.

According to one embodiment, the retained means are constituted by at least one lever mounted pivotally under the influence of a drive means such as a jack, relative to a support movable on a fixed frame and drivable with movement in a direction opposite the direction of advance of the layer of folders, a fixed belt being would about the lever and the support such that upon recoil of the lever and the support, the fixed belt unrolls and, being in contact with the folders of the layer, gives rise according to its unrolling, to the successive stopping of said folders interfingering between said belt and the path of the layer, thereby reducing the interval of said folders.

The speed of driving the movement of the support of the retaining means, also called the speed of the retained means, is proportional to the speed of advance and permits defining the interval between the folders.

Preferably, the speed of the retaining means is a speed proportional to the speed of advance, the ratio of the proportion being fixed no matter what the speed of the layer. For this reason, the device guarantees a synchronism of the speed of the retaining means relative to the speed of advance.

Thus, generally speaking, the new interval of the layer P' resulting from the separation, can be defined by the following equation:

$$P' = P \times \frac{Vr}{Vr \times Va}$$

In which P is the interval of the layer, Vr the speed of the retaining means and Va the speed of advance of the layer of folders.

Thus, if the retaining means for the folders has a speed equal to the speed of advance of the layer, the interval of the layer will be reduced to half during separation.

In all the cases to permit a separation member of a height H to pass between the separated folders without tearing or carrying away a folder which has not arrived below, it is necessary that the separation device for the layer carries out an offset between the two upper folders at the height of the separation member to be introduced.

According to another embodiment, the retention means can be constituted by a series of shafts located below the layer of folders, driven independently from each other, constituting for example a portion of the conveyor of the layer of folders, said shafts being driven at a speed identical to the speed of the layer and the first shaft of the series being positioned substantially facing the blocking means for a folder such that, when said blocking means act, the first shaft is thus stopped, then the second, then the third and so on, all the folders stopping one after the other at an equal distance from the preceding one.

Thus the new interval of the layer P' satisfies the following formula:

$$P' = P \times \frac{Vr}{Vr \times Va}$$

P being the interval of the layer of folders, Va the speed of the layer of folders and Vr being the speed of propagation of the stopping of the shafts in the direction of recoil, which is to say Vr=Da/T, Da being the distance between the axes of the two shafts and T the time between the stopping of one shaft and the stopping of the immediately following shaft.

BRIEF DESCRIPTION OF THE DRAWINGS

The invention will now be described in greater detail with reference to the drawing, in which.

DESCRIPTION OF THE PREFERRED EMBODIMENTS

The device 1 is mounted above a horizontal conveyor on which circulates a layer 2 of folders C.

The device according to the invention is constituted by a fixed frame 3 adapted to be mounted above the path of a layer 2 of folders.

Figure 1:
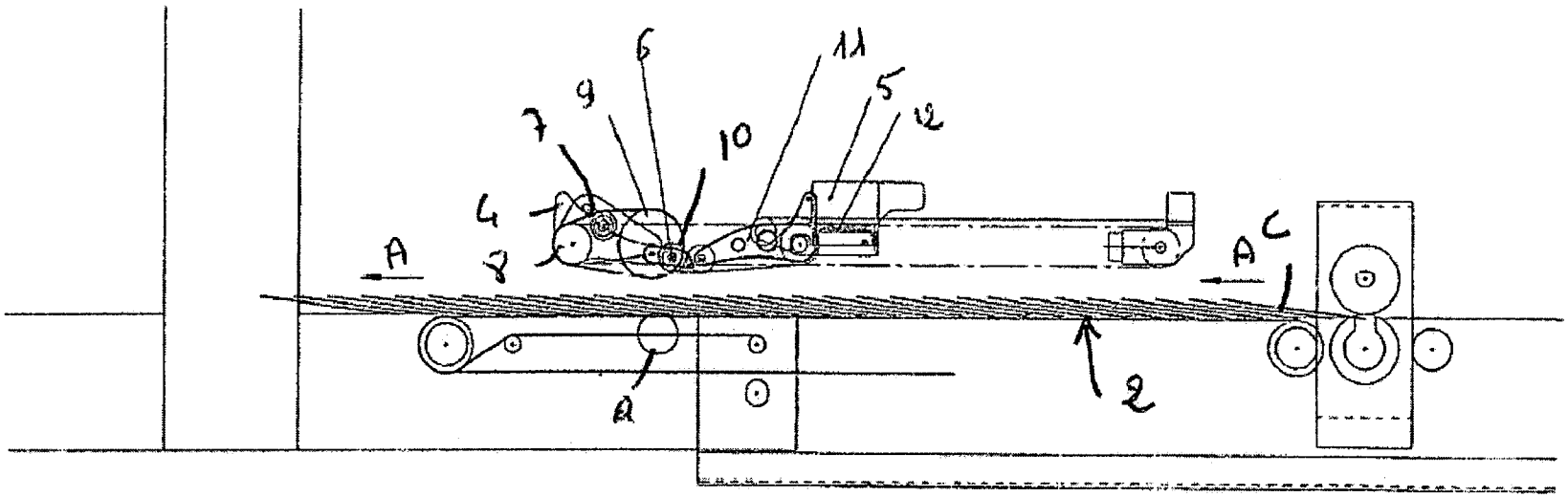
FIG. 1 is a schematic side view of a separation device according to the invention positioned above a layer of folders in the inactive position.
Figure 2:
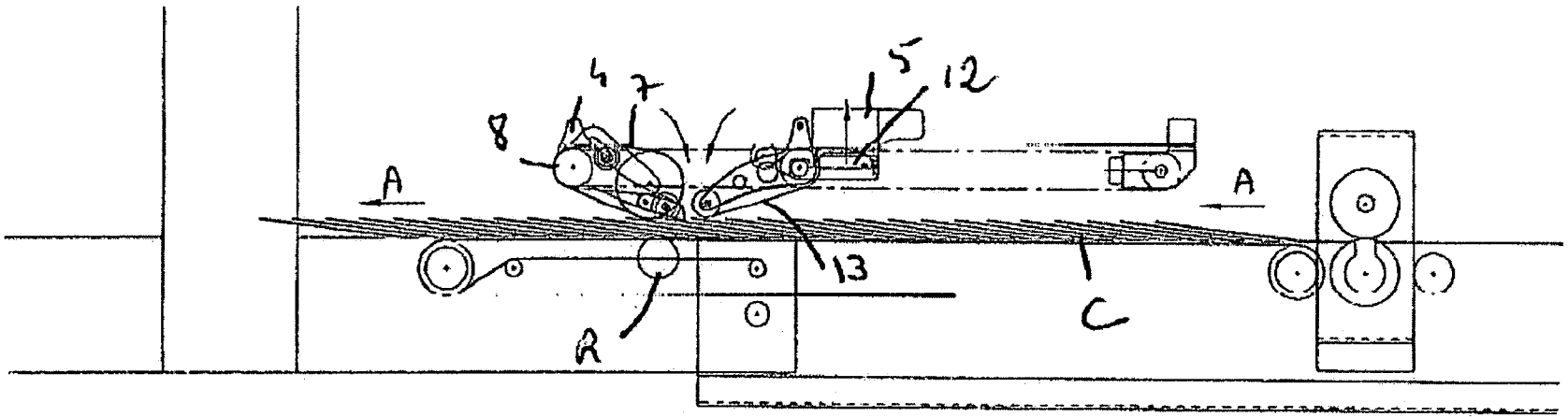
FIG. 2 shows the device according to FIG. 1 in the position just before separation.
Figure 3:
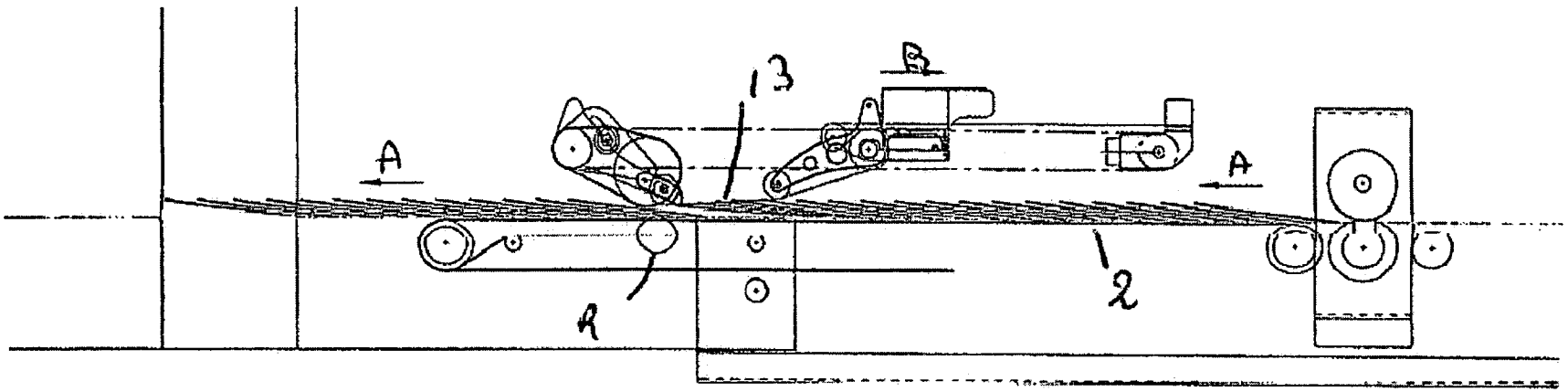
FIG. 3 shows the device of FIG. 1 in the blocking position of the folder.
Figure 4:
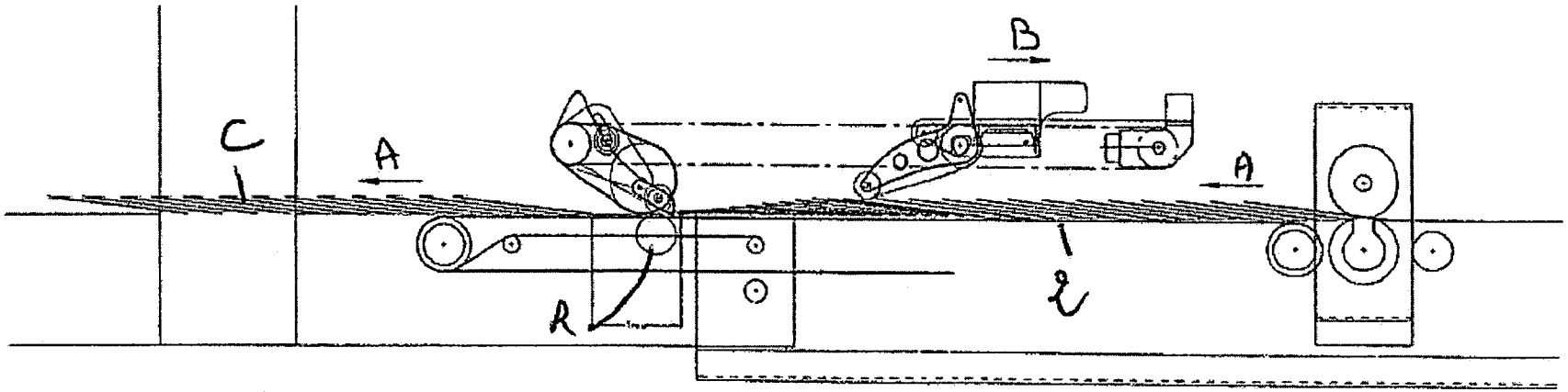
FIG. 4 shows the device of FIG. 1 in the position of recoil relative to the folders.

The blocking means, the unlayering means and the retention means are mounted pivotally on the frame 3 so as to be driven with pivotal movement between 1) an inactive position in which they are disposed substantially in the plane of the fixed frame 3 (FIG. 1) and 2) an active separation position in which they are lowered into contact with the layer 2 of folders (FIGS. 2, 3 and 4).

The unlayering means are positioned, relative to the direction of advance of the layer 2 shown by the arrow A, downstream of the blocking means on a same support 4 mounted pivotally relative to the fixed frame 3, under the action of a drive means for pivoting them, such as a jack.

These unlayering and blocking means are themselves disposed, relative to the direction of advance of the layer 2, downstream of the retention means, carried by a second support 5.

The blocking means are constituted of at least one blocking finger 6 pivotally mounted on the support 4 about an axis perpendicular to the direction of advance of the layer 2, at the upstream end of said support 4.

The blocking finger 6 is held in inactive position by a return means for example a resilient element, such as a spring or a motorized means and is brought to the active position under the influence of a drive means such as a jack. The pivotal axis of the blocking finger 6 being located downstream of the point of blockage in the layer 2, the blocking finger 6 acts because of this on the surface of the layer 2.

The unlayering means are constituted by at least one belt 7 driven between a wheel 8 mounted on the support 4, opposite the blocking finger 6, and a wheel 9 of larger diameter positioned adjacent the blocking finger 6, downstream of this latter in the direction of advance of the folders.

A roller 10 whose axis of rotation is close to or coincident with the pivotal axis of the blocking finger 6, also forms a portion of said unlayering means. Preferably, a roller R is positioned facing the unlayering wheel 9 below the layer 2 of folders.

Preferably, the conveyor for the layer 2 of folders comprises idle rollers below the blocking fingers 6 and the unlayering wheels 8, 9, these idle rollers being driven by friction of the belt of the conveyor at the same speed as the latter and stopping when the blocking fingers 6 bear against the blocked folder but not preventing the previous folder from being extracted by the unlayering wheels 8, 9.

Preferably, these rollers have two different diameters, one to be driven by the belt and the other larger diameter to disengage the folder from the lower belt so as not to drive it from below, when the blocking fingers 6 come to bear from above and no longer pinch it against the belt but against the idle roller which then stops.

The means for retaining the folders are constituted by at least one lever 11 pivotally mounted under the influence of a drive means such as a jack, relative to the support 5 and by a fixed belt 13 would about the lever 11 and the support 5.

The belt 13 is fixed at one of its ends to the blocking finger 6 and at its other end to the fixed frame 3 at the upstream end of this latter. The support 5 movable relative to the fixed frame 3 is driven in the direction contrary to the direction of advance such that by recoiling the lever 11 and the support 5, the fixed belt 13 unrolls and, being in contact with the folders of the layer 2, gives rise to the successive stopping of the interleaved folders between said belt 13 and the path of the layer 2, thereby reducing the interval of said folders.

This support 5 is drivable in movement by securement of said support under the influence of a gripping module 12 with a belt 14 driven in the reverse direction B to the direction of advance A between the upstream end and the downstream end of the fixed frame 3. Preferably, the device also comprises rollers provided on the diagonal in the conveyor of the layer 2 of folders facing the fixed belt 13, to perform the same function as the idle rollers, below the fixed belt 13 which unrolls. Thus, the last folder being extracted is also gripped by the fixed belt 13 which unrolls and hence also risks tearing by the extraction movement which is opposed to the gripping movement by the upper belt 13 which applies itself.

As can be seen from FIG. 1, when the first jack is actuated, the support 4 pivots toward the layer 2 and the roller 10 enters into contact with the layer 2.

The blocking finger 6 is lowered simultaneously and slides on a folder which is thus located engaged between the roller 10 and the large unlayering wheel 9 (FIG. 2).

The folder that is thus engaged is extracted by the unlayering belt 7. As soon as the rear of the folder has cleared the roller 10, the blocking finger 6 returned by the spring, pivots toward the layer 2 and blocks the following folder (FIG. 3).

Figure 5:
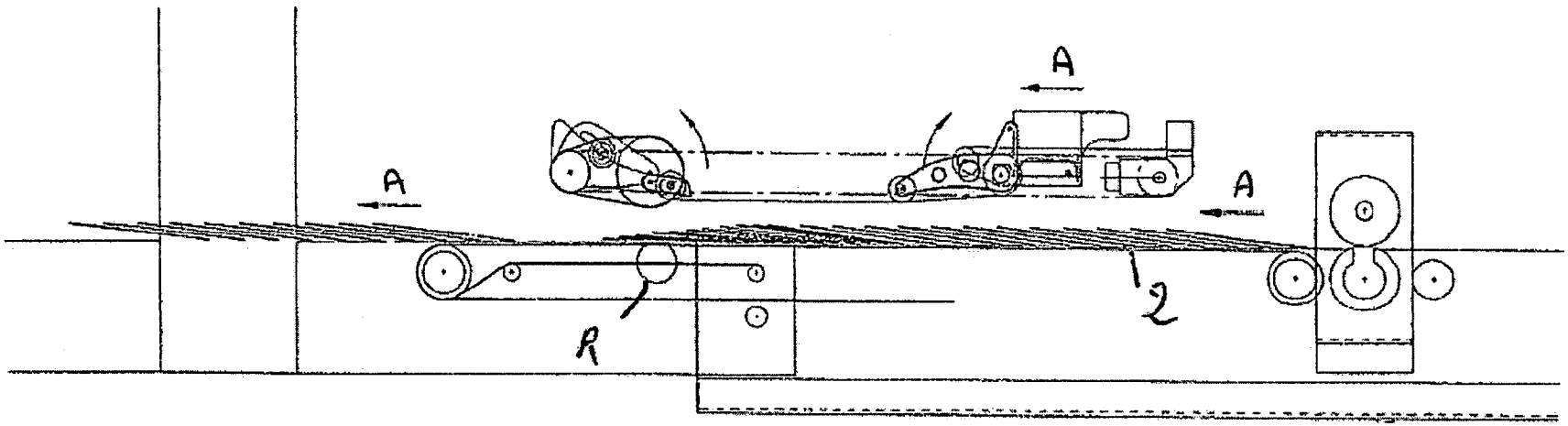
FIG. 5 shows the device of FIG. 1 after separation.

As soon as the length of interruption is obtained, the jack permits the support 4 to return to the inactive position (FIG. 5).

Parallel to the lowering of the unlayering means and blocking means, the support 5 is also lowered such that the lever 11 rests against the layer 2, the fixed belt 13 enters into contact with the layer 2.

A gripping module 12 mounted on the support 5 then intervenes to pinch the belt 14 which moves in a direction opposite to the direction of advance of the layer 2, such that the support 5 becomes secured to this belt 14.

The driving movement of the support 5 and, as a result of the lever 11, gives rise to the unrolling of the fixed belt 13 in contact with the layer 2, which stops each folder to the extent the fixed belt 13 unrolls and has the result of reducing the interval between each folder.

When the interruption of the layer 2 is completed, the assembly of jacks is released, which drives the rising of the blocking finger 6 and the unlayering means, the rising of the lever 11 and the freeing of the support 5 and of the belt 14. The fixed belt 13 rolls up again and returns the support 5 to its initial position (FIG. 5).

The mentioned element, blocking finger 6, fixed belt 13, unlayering belt 7, associated wheel 9, roller 10 and lever 11 are described as being single but could also be, in the separation device according to the invention, two or more in number.

The invention claimed is:

1. Device for the separation of folders in a layer of folders, comprising:

blocking means for blocking an advance of a folder in a layer of folders, unlayering means for unlayering folders, the unlayering means located downstream of the blocking means, a fixed frame (3) adapted to be mounted above the path of a layer (2) of folders, and retaining means for retaining the blocked folder and folders following the blocked folder relative to the advance of the layer (2), the retaining means acting successively on said blocked folder and said following folders, wherein, the unlayering means comprises at least one belt (7) driven about a wheel (8) mounted on a support (4) and another wheel (9), and the retaining means comprises at least one lever (11), and at least the blocking means and the unlayering means pivotally mounted to the fixed frame so as to be driven pivotally between an inactive position in which the blocking means and the unlayering means are disposed substantially in the plane of the fixed frame (3) and an active separation position in which the blocking means and the unlayering means are lowered into contact with the layer (2) of folders.

2. Device according to claim 1, wherein, the unlayering means are positioned downstream of the blocking means, and the blocking means are disposed downstream of the retaining means, in the direction of advance (A) of the layer (2) of folders.

3. Device according to claim 2, wherein, the support is a pivotable support (4), and the blocking means are constituted by at least one blocking finger (6) pivotally mounted about an axis perpendicular to the direction of advance (A) of the layer (2) at the end of the pivotable support (4) pivotally mounted relative to the frame (3), said blocking finger (6) being held in inactive position by a return means and being brought to active position under the influence of a drive means.

4. Device according to claim 3, wherein, the another wheel (9) is of a larger diameter than the wheel (8) mounted on the pivotable support (4), and the another wheel is positioned adjacent the blocking finger (6), downstream of the blocking finger in the direction of advance (A) of the folders, the unlayering means further comprising a roller (10) with an axis of rotation near or coincident with the pivotal axis of the blocking finger (6).

5. Device according to claim 3, wherein the drive means is a jack.

6. Device according to claim 1, wherein the retaining means are also pivotally mounted on the frame (3) so as to be driven pivotally between an inactive position in which the retaining means are disposed substantially in the frame of the fixed frame (3) and an active separation position in which the retaining means are lowered into contact with the layer (2) of folders.

7. Device according to claim 1, wherein, the at least one lever of the retaining means is pivotally mounted under the influence of a drive means, relative to another support (5) movable on a fixed frame (3) and drivable in movement in the direction (B) contrary to the direction of advance (A) of the layer of folders, the retaining means further comprising a fixed belt (13) wound about the lever (11) and the another support (5) such that by returning the lever (11) and the another support (5), the fixed belt (13) unrolls and, being in contact with the folders of the layer (2), give rise to progressive stopping of said folders interleaved between said fixed belt (13) and the path of the layer, thereby reducing the interval of said folders.

8. Device according to claim 7, wherein, the another support (5) is drivable in movement by securement of said another support under the influence of a gripping module (12) with a driven belt (14) driven in the reverse direction (B) to the direction of advance (A) between the upstream and the downstream end of the fixed frame (3).

9. Device according to claim 7, wherein, a conveyor of the layer (2) of folders comprises idle rollers, having two diameters, below the blocking fingers and unlayering wheels, the idle rollers being driven by friction with a belt of the conveyor at the same speed as the conveyor belt and stopping when the blocking fingers bear against the retained folder but not preventing the previous folder from being extracted by the unlayering wheels.

10. Device according to claim 9, further comprising rollers provided on the diagonal in the conveyor of the layer (2) of folders facing the fixed belt (13).

11. Device according to claim 7, wherein the speed in the reverse direction of the retaining means is a speed proportional to the speed of advance, the ratio of proportion of being fixed no matter what the speed of the layer.

12. Device for the separation of folders in a layer of folders, comprising:

blocking means for blocking an advance of one folder from a layer of folders, the blocking means comprising a blocking finger pivotally mounted;

unlayering means for unlayering folders, the unlayering means located downstream of the blocking means, the unlayering means comprising a belt (7) driven about two wheels (8, 9), one of the two wheels mounted on a pivotable support (4);

retaining means for successively retaining, relative to the advance of the layer, the blocked folder and folders following the blocked folder, the retaining means comprising at least one lever (11); and a fixed frame (3) adapted to be mounted above the path of a layer (2) of folders, at least the blocking means and the unlayering means pivotally mounted to the fixed frame so as to be driven pivotally between an inactive position in which the blocking means and the unlayering means are disposed substantially in the plane of the fixed frame (3) and an active separation position in which the blocking means and the unlayering means are lowered into contact with the layer (2) of folders.

13. A device for the separation of folders in a layer of folders circulating on a conveyor, comprising:

a fixed frame (3) adapted to be mounted above a path of an advancing layer (2) of folders circulating on a conveyor in a direction of advance (A);

a blocking means, comprising a pivotally mounted blocking finger, for blocking an advance of a folder from within the advancing layer of folders;

an unlayering means for unlayering folders, the unlayering means located downstream of the blocking means; and a retaining means, comprising a pivotable lever, for retaining the blocked folder and folders following the blocked folder, relative to the advance of the layer (2), the retaining means acting successively on each of the blocked and following folders, wherein, the blocking means, the unlayering means and the retention means are mounted pivotally on the frame drivable with pivotal movement between i) an inactive position with the blocking means, the unlayering means and the retention means disposed substantially in the plane of the fixed frame and ii) an active separation position with the blocking means, the unlayering means and the retention means lowered into contact with the layer of folders.

14. The device of claim 13, further comprising:

a first support (4) mounted pivotally, relative to the fixed frame (3), wherein the unlayering means is positioned, relative to the direction of advance, downstream of the blocking means, on the support (4); and a second support (5), the unlayering means and blocking means carried, relative to the direction of advance, downstream of the retention means, by the second support.

15. The device of claim 14, wherein, the blocking finger (6) is pivotally mounted on the first support (4) about an axis perpendicular to the direction of advance, at an upstream end of the first support (4), the blocking finger (6) is held in an inactive position by a return means and brought to an active position by a drive means, and the blocking finger acts on a surface of the layer to block the advance of the one folder.

16. The device of claim 15, wherein the unlayering means comprising a first belt (7) driven between a first wheel (8) mounted on the first support 4.

17. The device of claim 16, wherein the lever of the retaining means is pivotally, relative to the second support (5).

18. The device of claim 17, wherein the second support (5) is movable relative to the fixed frame (3).

* * * * *